US008720897B1

(12) United States Patent
Butcher et al.

(10) Patent No.: US 8,720,897 B1
(45) Date of Patent: May 13, 2014

(54) TIMER CONTROLLED BUILDING AND DEMOLITION GAME APPARATUS

(71) Applicant: Hasbro, Inc., Pawtucket, RI (US)

(72) Inventors: Stephen W Butcher, Monson, MA (US); Daniel Sanfilippo, Barrington, RI (US); Dustin DePenning, Providence, RI (US); Lee M Lenkarski, Belchertown, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 13/678,778

(22) Filed: Nov. 16, 2012

(51) Int. Cl.
*A63F 9/26* (2006.01)

(52) U.S. Cl.
USPC ..... 273/450; 273/445; 273/446

(58) Field of Classification Search
USPC ..... 273/440, 445, 446, 449, 450
See application file for complete search history.

(56) References Cited

U.S. PATENT DOCUMENTS

| | | | | | |
|---|---|---|---|---|---|
| 3,565,426 | A | | 2/1971 | Glass et al. | |
| 3,710,455 | A | | 1/1973 | Liversidge et al. | |
| 3,712,616 | A | * | 1/1973 | Goldfarb et al. | 273/447 |
| 4,135,715 | A | | 1/1979 | Soulos | |
| 4,293,128 | A | * | 10/1981 | Ebel | 273/450 |
| 4,320,901 | A | | 3/1982 | Morrison et al. | |
| 4,343,475 | A | | 8/1982 | Stader | |
| 4,394,017 | A | | 7/1983 | Maloy | |
| 4,522,393 | A | * | 6/1985 | Dunn | 273/447 |
| 4,763,898 | A | | 8/1988 | Hemmann | |
| 4,783,074 | A | | 11/1988 | Kobayashi | |
| 4,880,231 | A | | 11/1989 | Kobayashi | |
| 4,936,575 | A | | 6/1990 | Ortiz | |
| 5,611,544 | A | * | 3/1997 | Grebler et al. | 273/447 |
| 6,022,026 | A | * | 2/2000 | Johnson, III | 273/450 |
| 6,679,496 | B2 | * | 1/2004 | Grebler et al. | 273/290 |
| D514,629 | S | * | 2/2006 | Butcher | D21/386 |
| 7,052,013 | B2 | * | 5/2006 | Olsen | 273/450 |
| 7,059,606 | B2 | * | 6/2006 | Butcher et al. | 273/450 |
| 7,234,703 | B1 | | 6/2007 | Kusz | |
| 7,694,975 | B1 | * | 4/2010 | Darby | 273/450 |
| 7,900,930 | B2 | * | 3/2011 | Donegan et al. | 273/450 |
| 2002/0024180 | A1 | * | 2/2002 | Dalton | 273/450 |
| 2005/0093244 | A1 | * | 5/2005 | Olsen | 273/450 |
| 2005/0104298 | A1 | * | 5/2005 | Butcher et al. | 273/450 |
| 2008/0237991 | A1 | * | 10/2008 | Paul et al. | 273/450 |
| 2009/0045580 | A1 | | 2/2009 | Donegan et al. | |
| 2010/0264589 | A1 | | 10/2010 | Baum | |

* cited by examiner

*Primary Examiner* — Raleigh W Chiu
(74) *Attorney, Agent, or Firm* — Perry Hoffman

(57) ABSTRACT

Toy and game methods and apparatus including rectangular block elements layered to form a tower with upper and lower layers held by frictional coupling between the layers. The tower height increases during game play by removing blocks from one or more lower layers to build up successive upper layers upon an assembly platform. An upsetting element at the base transforms the blocks by dislodging the block elements with respect to the assembly platform by moving or traversing the assembly platform. A shifting mechanism may be provided in mechanical communication with the assembly platform for moving the platform between positions. A timer element establishes a predetermined time period from which the upsetting element transforms the block elements assembled atop the platform at an expiration of the set period of play time.

20 Claims, 10 Drawing Sheets

TIMER CONTROLLED BUILDING AND DEMOLITION GAME APPARATUS

BACKGROUND OF THE INVENTION

1. Field of the Invention

The present invention relates to timer controlled games and more particularly to a timer controlled building/demolition game which employs block elements built into a tower on a simple yet unique assembly platform which is linked to a timer for establishing a set period of play time and causing demolition of the tower in a fun and interesting way at the expiration of game play. The invention also relates to a method for playing a timer controlled building/demolition game.

2. Background of the Invention

There are several known game assemblies which utilize a timer device to create a sense of urgency during game play. Some of these game assemblies upset game pieces while some others only produce sound effects. A few of the game assemblies require a player to conduct a skill within a limited time before the placed skill game pieces are ejected from the game, and other game assemblies require a user to manipulate particular game pieces in order to retrieve specific objects before the objects are upset from a game platform. None of the known games however, employ block elements layered to form a tower on an assembly platform that communicates with a timer which drives contact between the platform and an upsetting element to dislodge the block elements from the platform causing demolition of the tower.

There is a known game apparatus which employs a timer in a base supporting a rotating platform that sets up a plurality of game pieces as exemplified and disclosed in U.S. Pat. No. 4,880,231 issued Nov. 14, 1989 to Kobayashi. A player utilizes a retrieving mechanism to magnetically retrieve set game pieces as the platform rotates. A timer element communicates with a hammer element which strikes the platform to upset the game pieces rotating on the platform after a set period of time.

There are a few known games which employ a spring loaded platform that ejects game pieces at the end of a specific period of game time. Loose game pieces are configured for selective emplacement upon a lowered platform as exemplified and disclosed in U.S. Pat. No. 4,763,898, issued Aug. 16, 1988 to Hemmann, and U.S. Pat. No. 3,710,455, issued Jan. 16, 1973 to Liversidge et al. A manual release mechanism in Hemmann is employed by a player to propel an opponent's platform upwardly to eject the opponent's game pieces when the player has succeeded in pacing all his game pieces correctly. Further, a latching means is in communication with the manual release as well as a timer element to automatically release both platforms at the end of specific period of play time. A latching means in Liversidge holds a game plate in a lowered position and is in communication with at timer that discharges game pieces on the plate at the end of a predetermined select time interval.

Additionally, there are a few known games which employ microprocessors to simulate a boom or explosion at the conclusion of a specific period of game time. A game resembling a bomb with the sound of a fuse is exemplified and disclosed in U.S. Pat. No. 4,320,901 issued Mar. 23, 1982 to Morrison et al. In Morrison, a keyboard on the bomb is employed to interact with a user and produce lights and sounds creating a sense of urgency as the user plays a memory game on the computer. At the end of a predetermined time, or if an incorrect key is pressed, the burning fuse sound stops and the sound of an explosion is created.

Another simulated explosion game employing a digital timer mounted in a housing shaped like a bomb is exemplified and disclosed in U.S. Pat. No. 7,234,703 B1 issued Jun. 26, 2007 to Kusz. The timer is set and displayed to a user and must be retrieved from a pool etc. by the user before the timer runs out and an explosion sound is produced.

Significantly, known timer controlled games do not combine an assembly platform and timer element for simply yet uniquely establishing a set period of play time and also causing demolition of a tower built on the platform at the expiration of game play. It would be desirable to provide a game having a timer element driving contact between an assembly platform supporting a tower of block elements which are alternately layered forming frictional coupling between the layers. An upsetting element to dislodges the block elements with respect to the assembly platform at the expiration of a set period of play time.

SUMMARY OF THE INVENTION

The present invention addresses shortcomings of the prior art to provide a toy apparatus which simply yet uniquely dislodges a tower of block elements from an assembly platform. A plurality of block elements alternately layered to form a tower creating frictional coupling between the layers is supported on the platform and linked to a timer element which drives contact between the platform and an upsetting element causing demolition of the tower at the expiration of game play.

In one embodiment of the invention, a toy includes a plurality of rectangular block elements layered to form a tower, the tower including one or more upper and lower layers with each adjacent layer stacked in an alternating direction to create frictional coupling between the layers, the tower height increasing during game play by removing blocks from one or more lower layers to build up successive upper layers, an assembly platform supporting the layered tower of blocks, a base resting on a surface supporting the assembly platform, and an upsetting element at the base for dislodging the block elements with respect to the assembly platform. A timer element at the base in communication with the assembly platform if further included and establishes a predetermined time period in which to play, driving contact between the assembly platform and the upsetting element to transform the block elements assembled on the platform at an expiration of the set period of play time.

In another embodiment, the assembly platform is affixed to traverse between a first position and a second position at the base, and in another embodiment, the toy further includes a shifting mechanism in mechanical communication with the assembly platform for traversing the platform between first and second positions. In another embodiment, the shifting mechanism further includes a lifting assembly for elevating the assembly platform from the base in the first position and a releasing assembly for dropping the platform toward the base in the second position.

In yet another embodiment, the lifting assembly is pivotably coupled to the base and includes a handle and one or more contacting surfaces for manually elevating the assembly platform from the base to the first position. In another embodiment, the releasing assembly further includes a release lever in mechanical communication with the timer element and one or more arm members for supporting the lifting assembly when elevating the platform in the first position, and releasing the lifting assembly to drop the assembly platform to the second position.

In another embodiment, the upsetting element is affixed to protrude through the assembly platform at the base when the platform is dropped from the first position to the second position. In another embodiment the timer element further includes a detonation lever for triggering the shifting mechanism to drop the assembly platform from the first position to the second position.

In still another embodiment, the timer element further comprises a gear assembly coupled to the detonation lever and a pull string for winding up the gear assembly. In still yet another embodiment, the timer element further includes an on/off lever in mechanical communication with the gear assembly for manually stopping the timer element to intermittently pause the set period of play time.

In another embodiment of the invention, a method for playing a timer controlled building/demolition game, includes the steps of providing a plurality of rectangular block elements layered to form a tower, the tower including one or more upper and lower layers with each adjacent layer stacked in an alternating direction to create frictional coupling between the layers, removing blocks from one or more lower layers to build up successive upper layers to increase the tower height during game play, providing an assembly platform supporting the layered tower of blocks, and providing a base resting on a surface supporting the assembly platform. Further steps include providing an upsetting element at the base for dislodging the block elements with respect to the assembly platform, providing a timer element at the base in communication with the assembly platform establishing a predetermined time period in which to play, and driving contact between the assembly platform and the upsetting element dislodging the block elements assembled on the platform at an expiration of the set period of play time.

In another embodiment, the step of traversing the assembly platform between a first position and a second position at the base is further included. In another embodiment, the step of providing a shifting mechanism in mechanical communication with the assembly platform for traversing the platform between first and second positions is also included.

In yet another embodiment, the step of providing a detonation lever at the timer element for triggering the shifting mechanism to drop the assembly platform from the first position to the second position is further included. In still another embodiment, the step of protruding the upsetting element through the assembly platform when the platform is dropped from the first position to the second position at the base is further included.

In an embodiment of the invention, a toy includes a base resting on a surface, an assembly platform affixed to traverse between a first position and a second position at the base, a plurality of rectangular block elements layered to form a tower at the assembly platform, the tower including one or more upper and lower layers with each adjacent layer stacked in an alternating direction to create frictional coupling between the layers, the tower height increasing during game play by removing blocks from one or more lower layers to build up successive upper layers, an upsetting element at the base for dislodging the block elements with respect to the assembly platform, and a timer element at the base in communication with the assembly platform establishing a predetermined time period in which to play, and at the expiration of play time, shifting the assembly platform from a first position to a second position driving contact with the upsetting element dislodging the block elements from the platform.

In another embodiment, a shifting mechanism in mechanical communication with the assembly platform is further included for traversing the platform between first and second positions. In another embodiment, the upsetting element is affixed to protrude through the assembly platform at the base when the platform is dropped from the first position to the second position.

In yet another embodiment, the timer element further includes a detonation lever for triggering the shifting mechanism to drop the assembly platform from the first position to the second position. In still yet another embodiment, the timer element further includes a gear assembly coupled to the detonation lever and a pull string for winding up the gear assembly.

Briefly the present inventions provide a unique toy having a plurality of block elements layered in an alternating fashion to form a tower creating frictional coupling between the layers and an assembly platform supporting the tower and in communication with a timer element. During game play lower layers of blocks are removed to build up successive upper layers and the timer element determines a period in which to play. The timer element also drives contact between the assembly platform and an upsetting element dislodging block elements from the platform at an expiration of the set period of play time.

BRIEF DESCRIPTION OF THE DRAWINGS

For the purpose of facilitating an understanding of the inventions, the accompanying drawings and description illustrate a preferred embodiment thereof, from which the inventions, structure, construction and operation, and many related advantages may be readily understood and appreciated.

FIG. 1A is a perspective view of a toy of the present invention illustrating a plurality of block elements layered to form a tower on an assembly platform supported by a base resting on a surface, while

FIG. 2A illustrates the assembly platform elevated to the first position on the base, while

FIG. 3A illustrates a shifting mechanism at the base and a lifting assembly in an elevated position with a releasing assembly is a biased position toward the lifting assembly, with FIG. 3B illustrating a contact between the lifting assembly and the platform, while

FIG. 5A illustrates a timer element with a detonation lever in a cocked position out of contact with the release lever, while

DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope to the present invention.

Figure 1A:
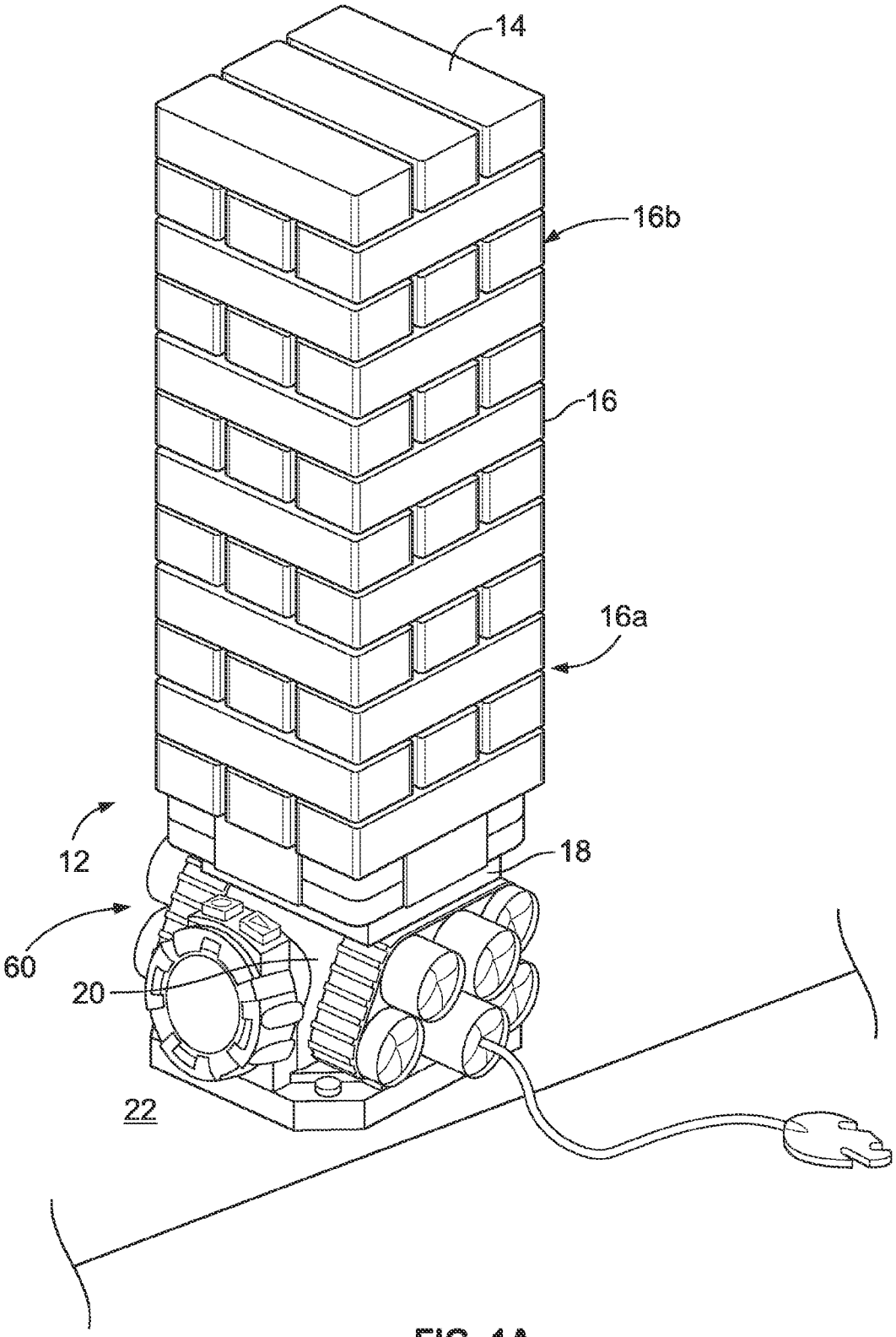
Figure 1B:
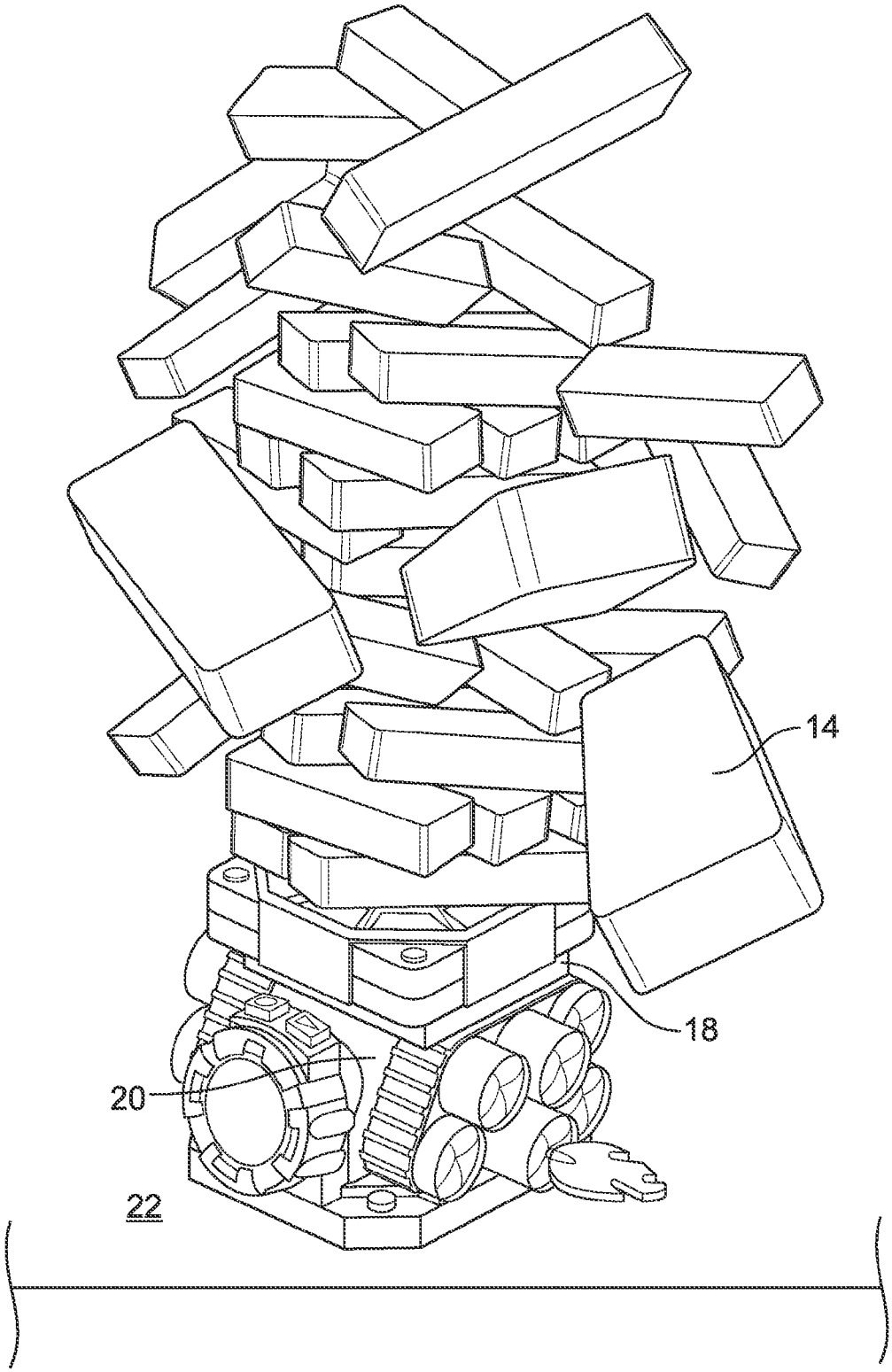
FIG. 1B illustrates the tower of block elements dislodging from the assembly platform.

A toy apparatus/game 12, as seen in FIGS. 1A and 1B, is generally seen to include a plurality of block elements layered to form a tower on a simple yet unique assembly platform. The platform is linked to a timer for establishing a set period of play time and for causing demolition of the tower in a fun and interesting way at the expiration of game play. The plurality of block elements 14, as seen in FIG. 1A are each generally rectangular in shape and layered to form a tower 16. The tower 16 includes one or more lower layers 16*a* and one or more upper layers 16*b* with each adjacent layer stacked in an alternating direction to create frictional coupling between the layers and adjacent blocks. In the present described embodiment, each layer of the tower includes three building blocks 14 laid length wise, as seen in FIG. 1A, with all the blocks of each layer orientated in the same direction. Additionally, there are roughly ten or twelve layers to the tower 16 at the start of the game.

The tower 16 height increases during game play by removing blocks from one or more lower layers 16*a* to build up successive upper layers 16*b*. In the present described embodiment, blocks removed from a lower layer are stacked on top of the tower, at a right angle to the blocks in the layer below. Additionally, the blocks 14 of the present invention are manufactured from wood and wood like materials and are all generally the same size and weight making their manufacture simple and inexpensive. The block elements are roughly three inches long and a half inch thick and generally have the physical characteristics and coefficient of friction needed to stack them well upon one another. It is also contemplated that the block elements 14 can include alternative sizes and a mix of sizes in the same toy apparatus and incorporate other suitable materials such as metal or plastic, creating a heavier or lighter stackable block element, or mix of block elements as needed.

The assembly platform 18 supports the layered tower 16 of block elements 14, as seen in FIG. 1A, and the assembly platform 18 is supported by a base 20 which rests on a surface 22. The assembly platform 18, as seen in FIG. 2A is generally a deck surface 18*a* sitting on the base providing a level, stable platform for supporting the tower in an upright position as the base rests on a surface.

In the present described embodiment, the assembly platform 18 is generally square in shape and is approximately three inches square in size, about the same size as three block elements 14 laid adjacent one another, which is sufficient to support the tower 16 on the platform. The assembly platform 18 and base 20 are manufactured from a heavy duty rigid plastic which is simple and inexpensive to manufacture into any desired shape and can easily include fun colors and patterns. The assembly platform 18 and base 20 are made to look like an explosive device, with heavy duty explosives sitting adjacent the platform to enhance the effect of the tower 16 being demolished at the end of game play, as seen in FIG. 1B. It is also contemplated that the platform and base can includes alternate shapes, such as a circular platform on a semi round base, and can include alternative suitable materials such as wood or metal.

Figure 2A:
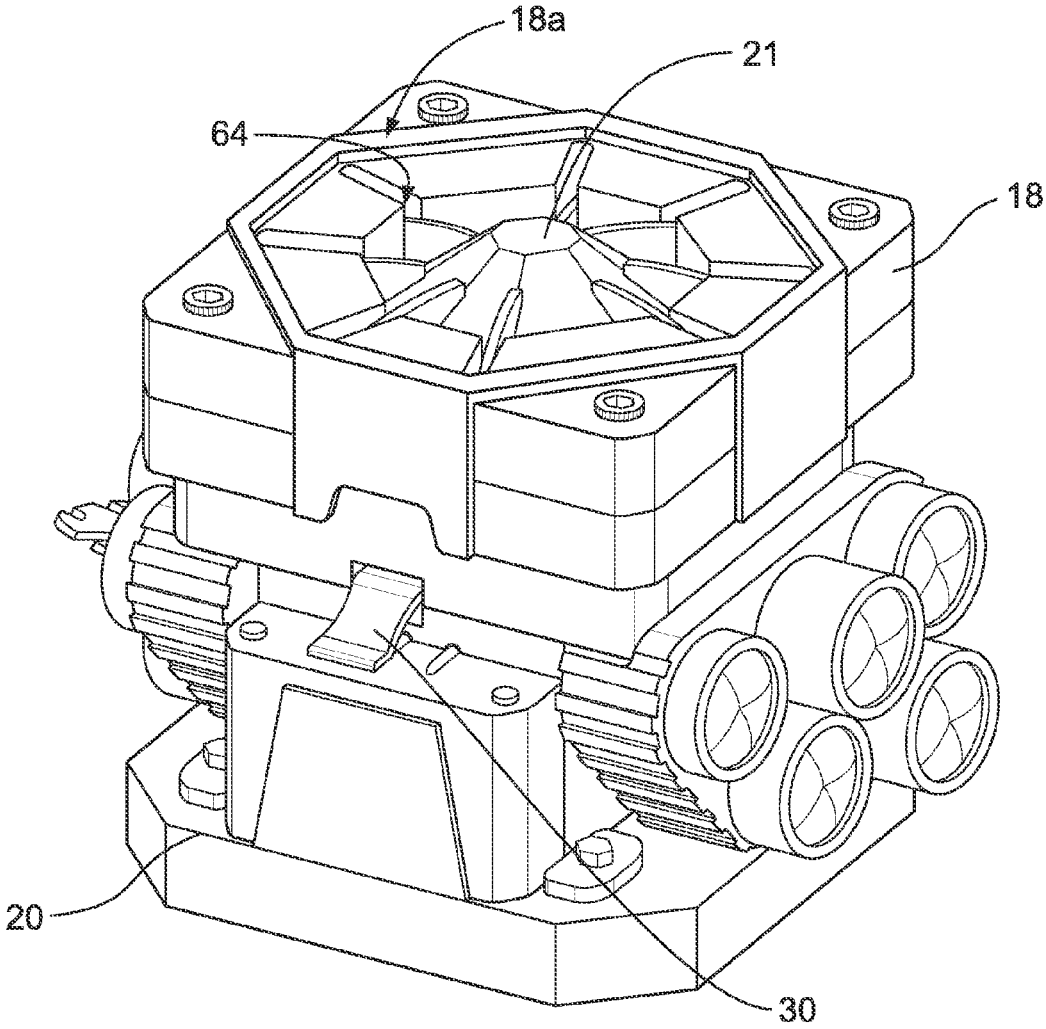
Figure 2B:
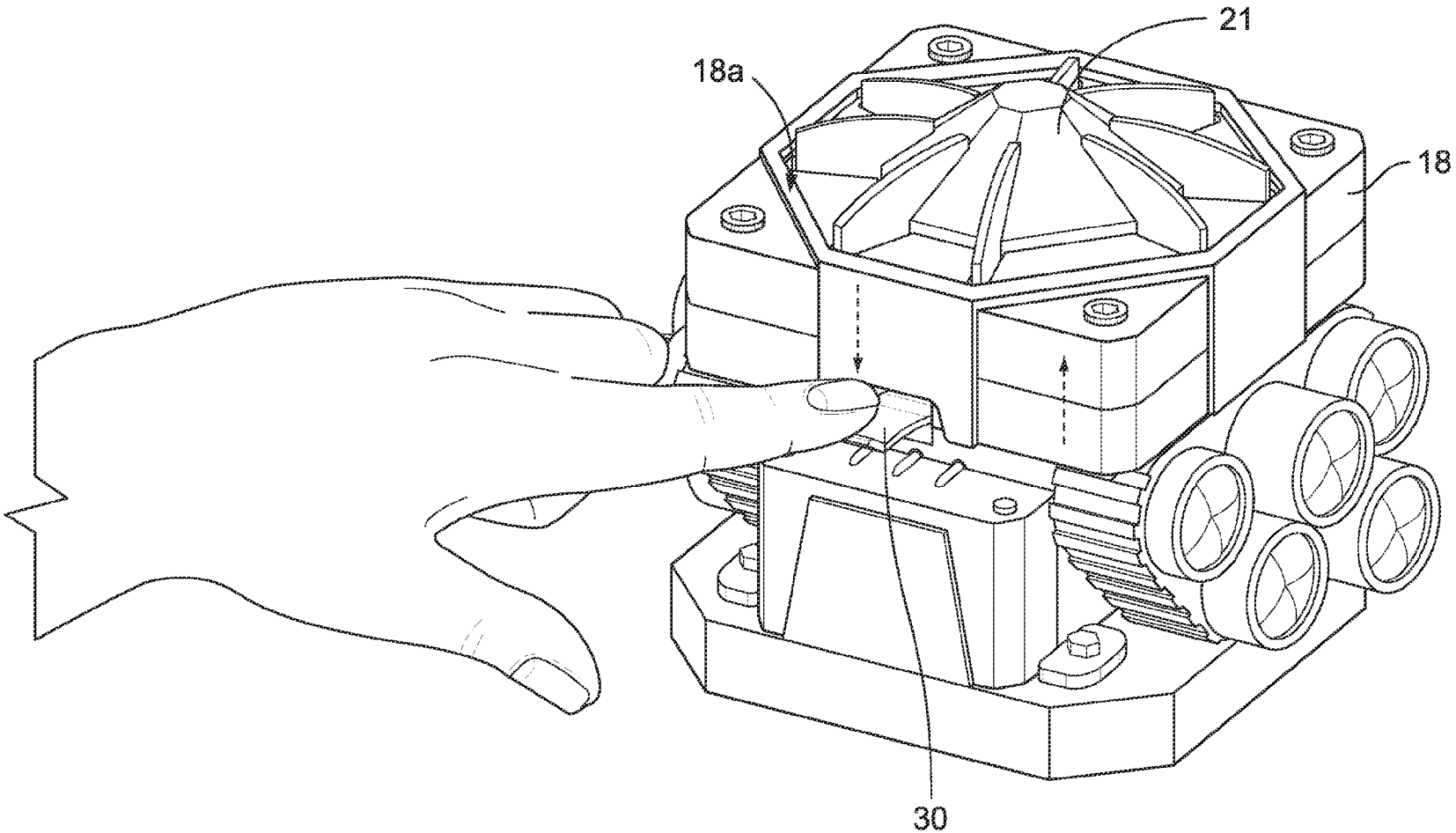
FIG. 2B illustrates the assembly platform dropped to the second position with an upsetting element protruding through the platform.

An upsetting element 21, as seen in FIG. 2B, is positioned at the base for dislodging the block elements 14 with respect to the assembly platform 18, as seen in FIG. 1B. The timer element 23 is also positioned at the base 20 and is in mechanical communication with the assembly platform. The timer element 23 establishes a predetermined time period in which to play and also drives contact between the assembly platform and the upsetting element dislodging the block elements assembled on the platform at an expiration of the set period of play time, as seen in FIG. 1B.

In the present described embodiment, the assembly platform 18 is affixed to traverse between a first position, as seen in FIG. 2A and a second position, as seen in FIG. 2B. The assembly platform 18 is elevated from the base 20 in the first position and dropped toward the base 20 in the second position, as seen in FIGS. 2A and 2B respectively. The assembly platform is sturdy enough to support the layered tower of block elements and also light weight enough to be easily elevated from a second position to a first position. As discussed, the apparatus with the rectangular block elements layered upon the supported assembly platform will incorporate an upsetting element at the base that transforms the blocks by dislodging the block elements with respect to the assembly platform by moving or traversing the assembly platform between a first and second position at the base. A shifting mechanism may be provided in mechanical communication with the assembly platform for moving the platform between positions. The timer element establishes a predetermined time period from which the upsetting element transforms the block elements assembled atop the platform at an expiration of the set period of play time.

Figure 3A:
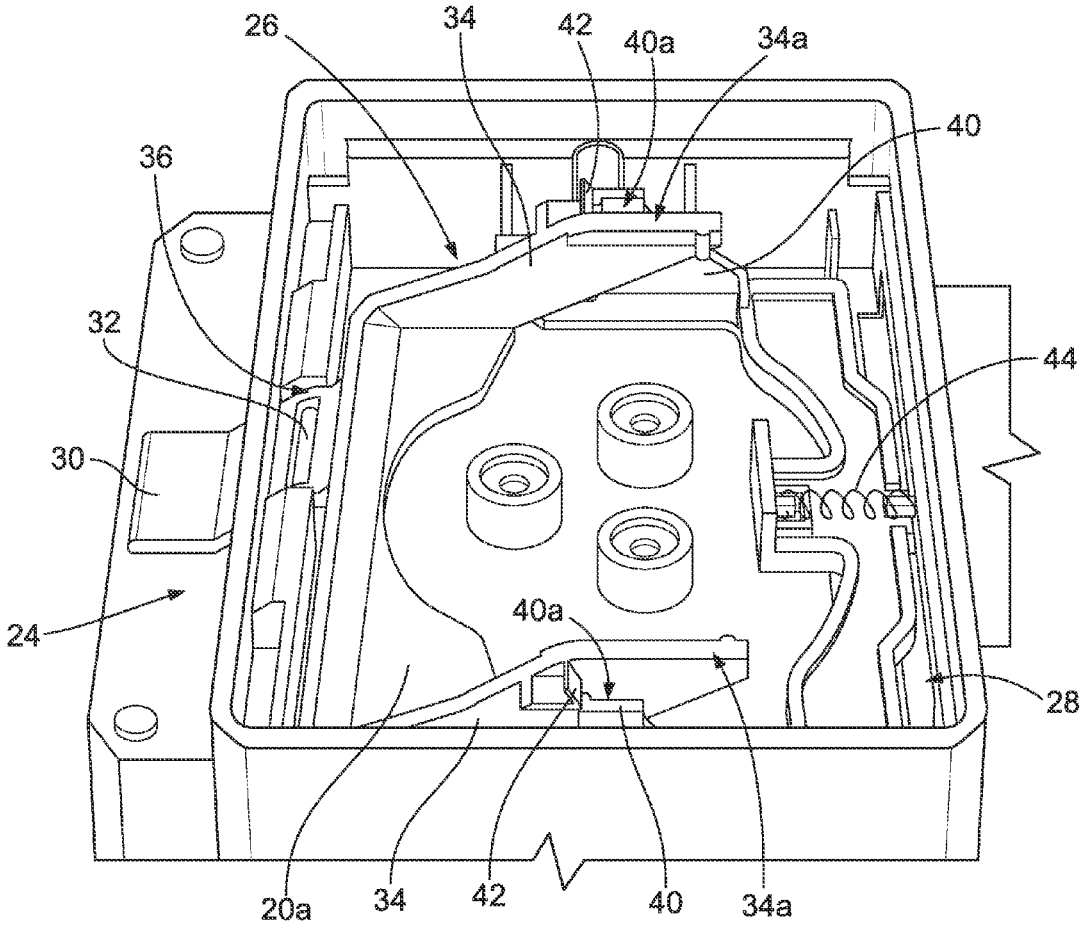
Figure 3B:
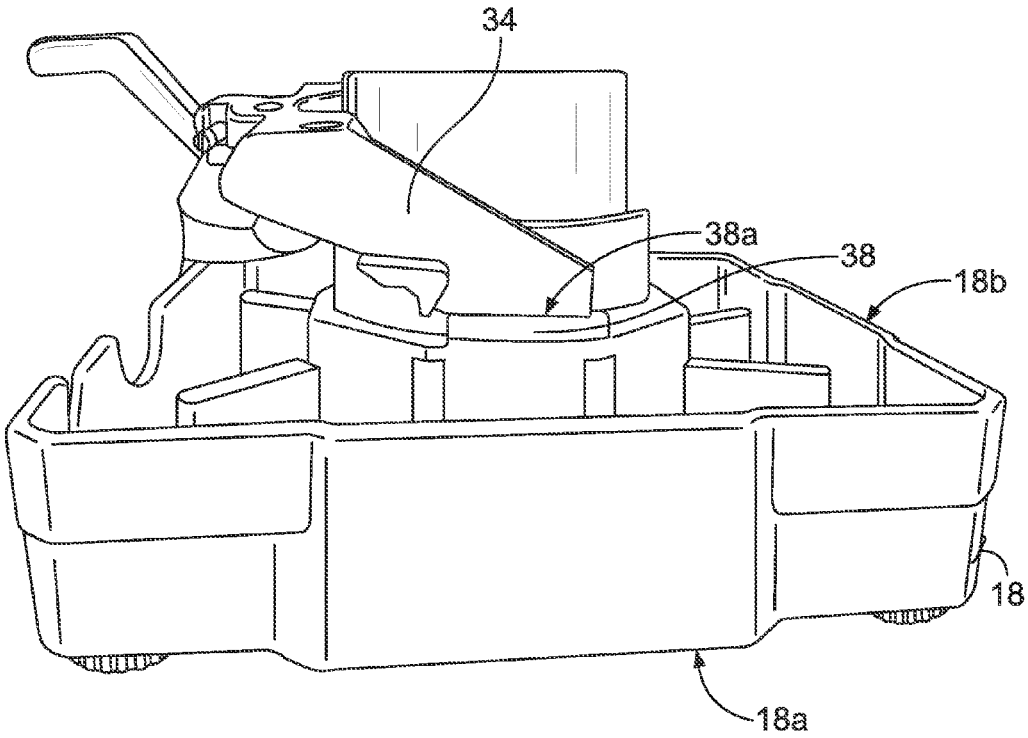
Figure 3C:
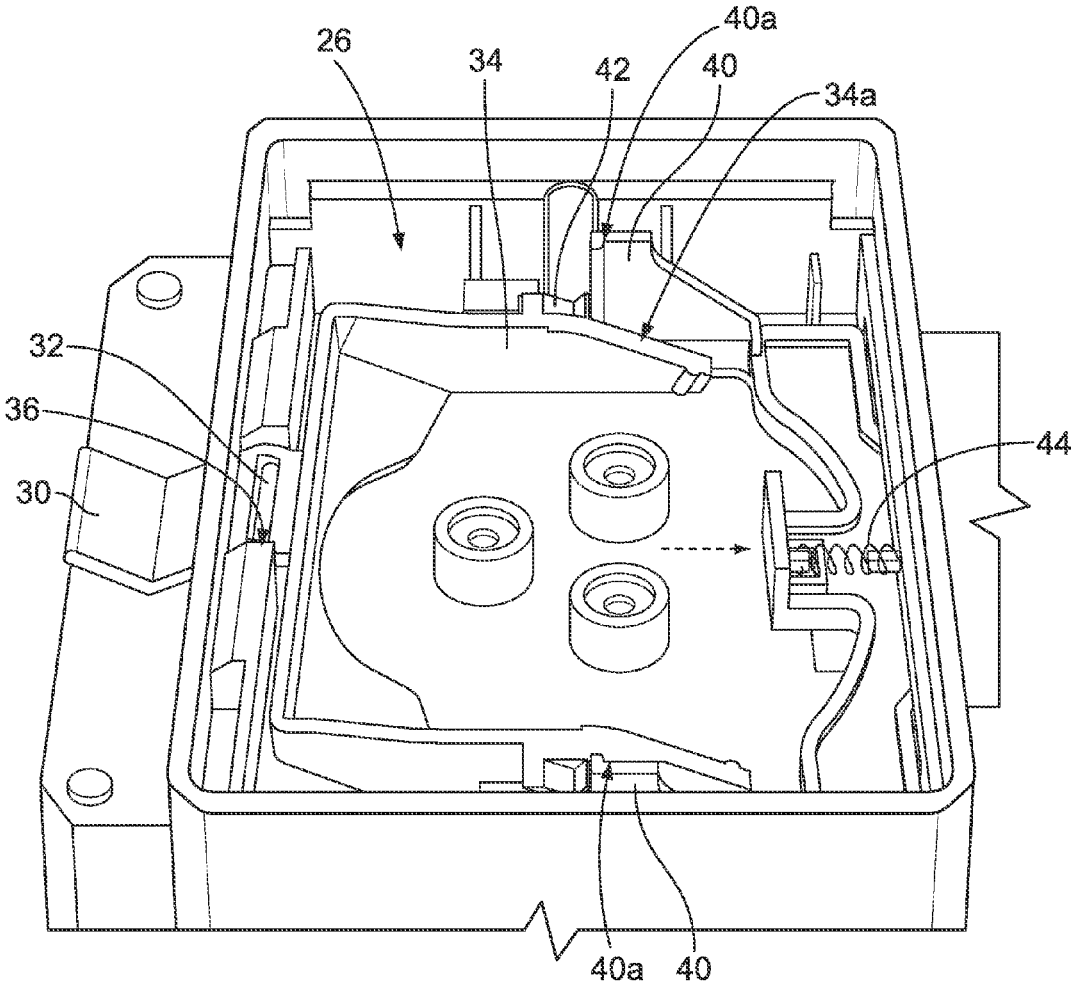
FIG. 3C illustrates the lifting assembly having fallen from an elevated position.

The shifting mechanism 24, as seen in FIGS. 3A and 3C, is in mechanical communication with the assembly platform 18 for traversing the platform between first and second positions. In the present described embodiment, the shifting mechanism 24 is housed in the base adjacent the assembly platform and is accessible to a user for manually shifting the assembly platform from the second position, as seen in FIG. 2B, to the first position, as seen in FIG. 2A. The shifting mechanism is also manufactured from a heavy duty rigid plastic which is simple and inexpensive to manufacture into any desired shape and yet still provides the strength needed to function effectively. It is also contemplated that the shifting mechanism can include alternative suitable materials such as wood or metal.

The shifting mechanism 24 further includes a lifting assembly 26 for elevating the assembly platform from the base in the first position, as seen in FIG. 2A and a releasing assembly 28 for dropping the platform toward the base in the second position, as seen in FIG. 2B. The lifting assembly 26 and releasing assembly 28 are partially contained within a compartment portion 20*a* of the base for maintaining contact between assemblies 26 & 28 and the assembly platform 18.

The lifting assembly 26 is pivotably coupled to the base at compartment portion 20*a*, as seen in FIG. 3A, and includes a handle 30 for manually elevating the assembly platform from the base to the first position. In the present described embodiment, a pivoting pin 32 is inserted through the lifting assembly 26 providing a pivot point from which two arm elements 34 extend in one direction with the handle 30 extending in an opposite direction. The pivoting pin 32 is inserted into a slot 36 in the compartment portion 20*a* such that the handle 30 extends out from the compartment portion 20*a* and is assessable to the user while the arm elements 34 are maintained within the compartment portion 20*a* of the base. Manually applying a downward force to the handle 30 transfers an opposite upward force to the arm elements 34 enabling the arm elements to elevate the assembly platform to a first position as seen in FIGS. 2A and 2B.

The lifting assembly 26 includes one or more contact surfaces 34*a* for elevating the assembly platform to the first position, as seen in FIG. 3A. In the present described embodiment, each arm element 34 includes a contact surface 34*a* at a distal end from the pivoting pin 32 for making contact with the assembly platform 18. The assembly platform includes two protrusions 38, as seen in FIG. 3B, at a surface 18*b* of the platform opposite the deck surface 18*a*, and includes two elongated surfaces 38*a* at the protrusions 38. The two surfaces 38*a* of the assembly platform make contact with the two contact surfaces 34*a* of the arm elements 34 forming stable and consistent contact points between the lifting assembly and the assembly platform to repeatedly lift the assembly platform to the first position.

The lifting assembly is held in the elevated position by the releasing assembly 28 which is biased in the direction of the lifting assembly 26, as seen in FIG. 3A. The releasing assembly also includes one or more arm members 40, each including a contact surface 40*a*, for supporting the lifting assembly in the elevated position. Each arm member 34 of the lifting assembly includes a protrusion 42 adjacent contact surfaces 34*a* for contacting the arm members 40 of the releasing assembly. Each protrusion 42 rests on a contact surface 40*a* to support the lifting assembly when elevating the platform in the first position, as seen in FIG. 3A, and each protrusion 42 falls from contact with surfaces 40*a* when the releasing assembly drops the assembly platform to the second position, as seen in FIG. 3C.

In the present described embodiment, a biasing spring 44 forces the releasing assembly toward the lifting assembly, as seen in FIG. 3A. Arms 40 are biased to maintain contact between surfaces 40*a* and protrusions 42, when arms 36 have been forced upward after a downward force has been applied to the handle 30. The biasing spring 44 will continue to maintain contact between surfaces 40*a* and protrusions 42 even when the downward force on the handle is released, until the releasing assembly is triggered by the timer element 46 to release the biasing force.

Figure 4:
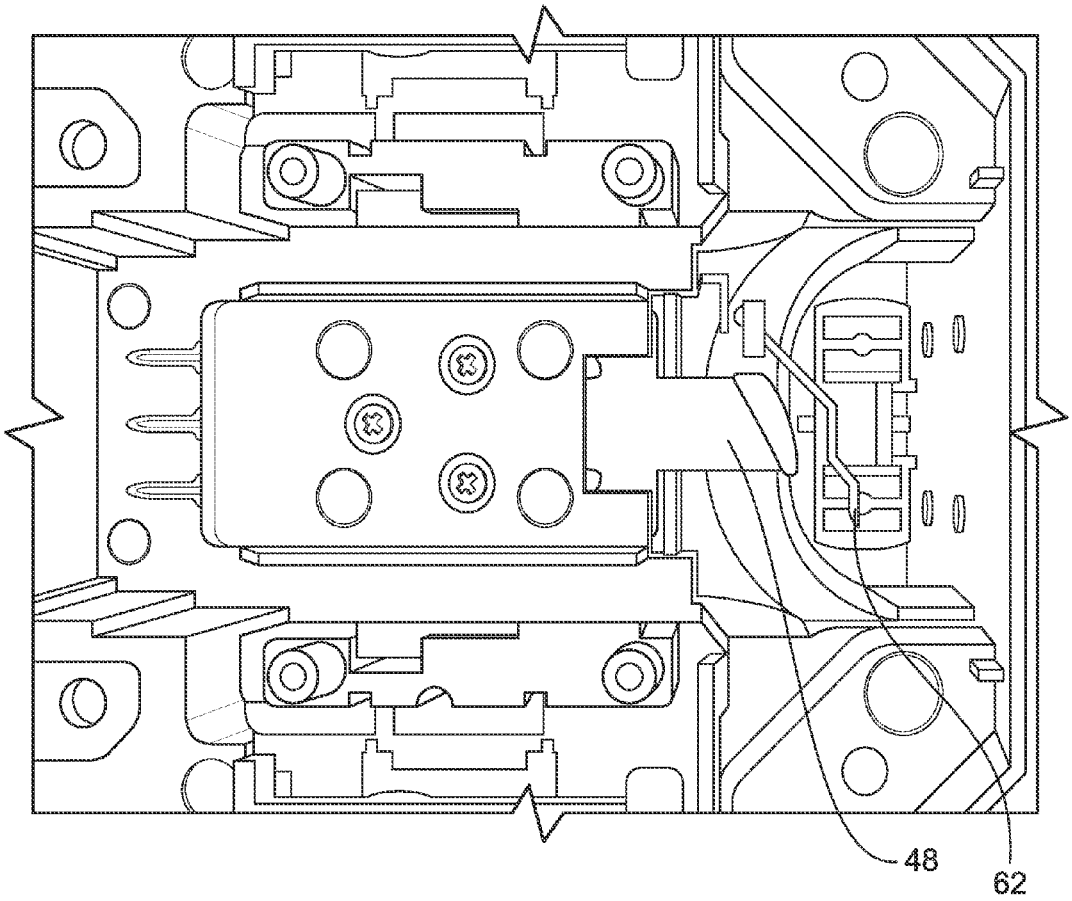
FIG. 4 illustrates a release lever of the releasing assembly.
Figure 5A:
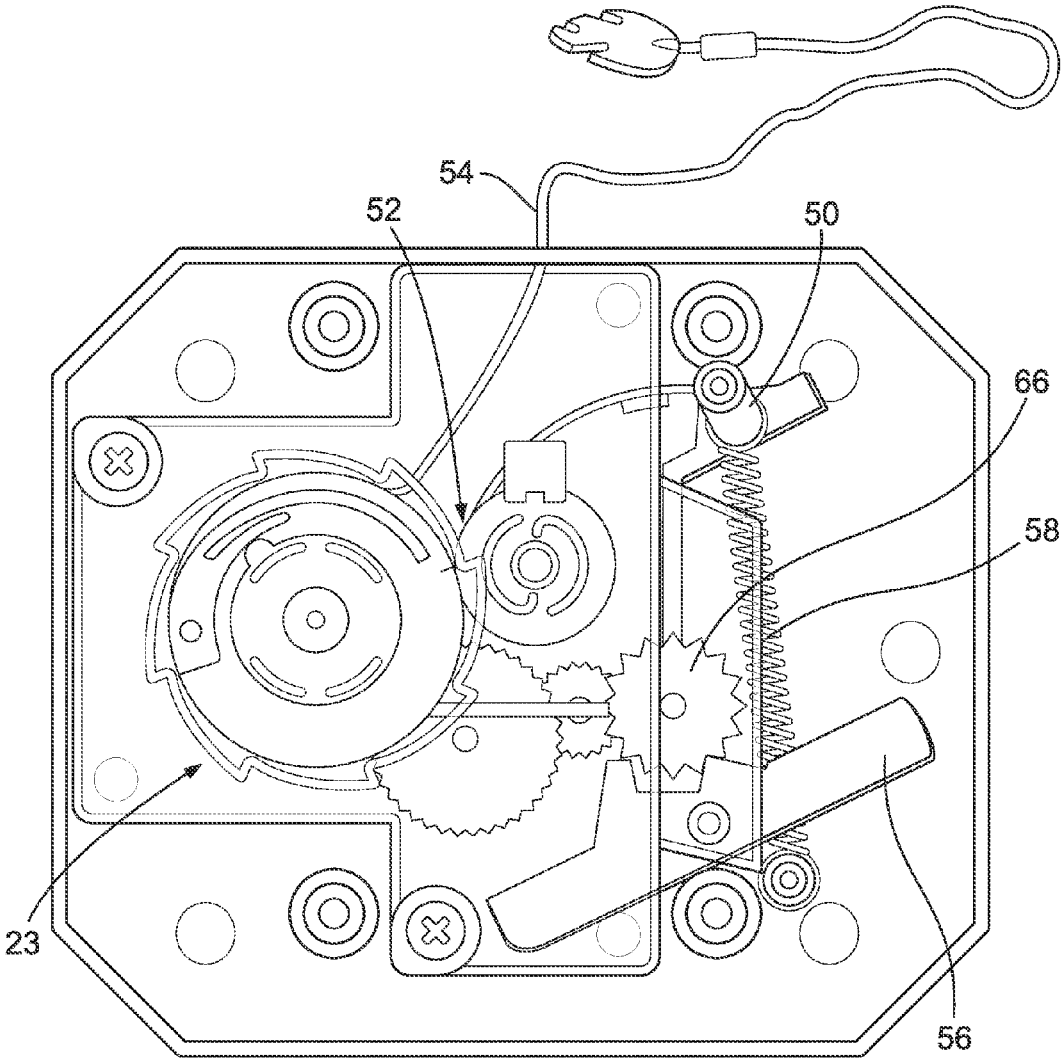
Figure 5B:
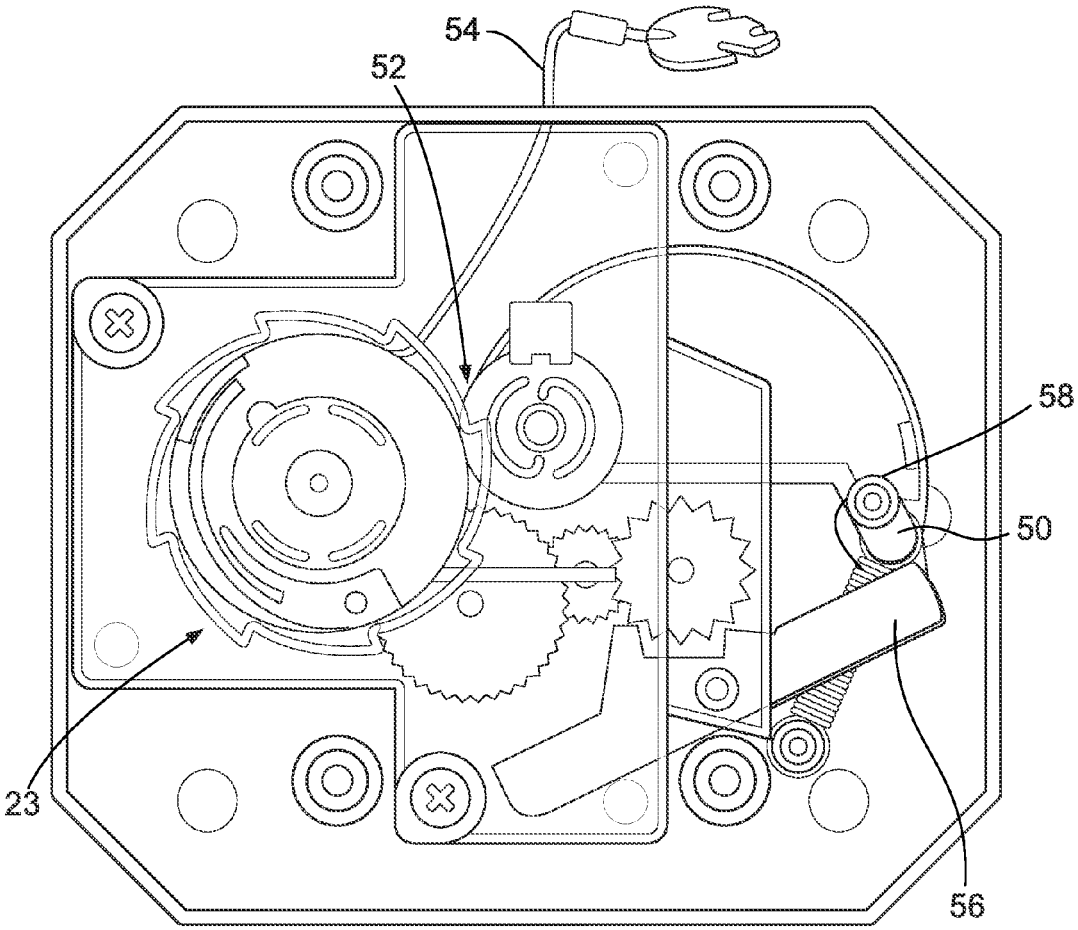
FIG. 5B illustrates the detonation lever of the timer element in a position for striking the release lever.

The releasing assembly 28 further includes a release lever 48, as seen in FIG. 4, in mechanical communication with the timer element 23, as seen in FIGS. 5A & 5B. In the present described embodiment, the release lever 48 is integral with the arms 40 and biased out of contact with the timer element 23 when the lifting assembly is in an elevated position.

The timer element 23 includes a detonation lever 50 for triggering the shifting mechanism to drop the assembly platform from the first position to the second position, a gear assembly 52 coupled to the detonation lever 50 and a pull string 54 for winding up the gear assembly 52, as seen in FIG. 5A. The timer element further includes an on/off lever 56 in mechanical communication with the gear assembly 52 for manually stopping the timer element to intermittently pause the set period of play time.

An on/off switch 60, as seen in FIG. 1, is accessible to the user and toggles back and forth to stop and start the wound up timer element during game play. A long lever 62 extends from on/off switch 60 toward on/off lever 56 of the timer element. The long lever 62 toggles into contact with on/off lever 56 forcing the lever 56 into contact with gear 66, as seen in FIG. 5A, to stop gear 66 from rotating and thus pausing the gear assembly 52 of the timer element 23. The long lever 62 also toggles out of contact with the on/off lever 56 releasing gear 66 to freely rotate and actuate the timer element resuming play as desired by the user.

In use, the user pulls on string 54 to wind up gear assembly 52, as seen in FIG. 5A, shifting the detonation lever 50 to a cocked position and out of contact with the release lever 48. A downward force is applied to the handle 30 shifting up the lifting assembly and elevating the assembly platform 18 to the first position. The releasing assembly is biased toward the lifting assembly, maintaining the lifting assembly in the elevated position and further biasing the release lever 48 from contact with the detonation lever 50.

The wound up gear assembly 52 establishes the predetermined time period in which to play and the platform 18 will remain in the elevated first position until the detonation lever 50 is triggered to strike the release lever 48. The user, at this time, can assemble the block elements 14 into a tower on the elevated assembly platform, as described above and seen in FIG. 1. The on/off switch is shifted to on and the user can proceed to play the game, removing blocks from lower layers to build up successive upper layers. The gear assembly 52 will unwind and trigger the detonation lever 50 to strike the release lever 48 at the same time that the string 54 is fully incorporated into the gear assembly 52.

Once the detonation lever 50 is triggered, the release lever 48 is struck and shifted against the force of the biasing spring 44 moving arms 40 of the releasing assembly away from protrusions 42 of the lifting assembly and dropping the lifting assembly from contact with the platform which then drops the platform from the first position to the second position. The upsetting element is affixed to protrude through the assembly platform at the base when the platform is dropped from the first position to the second position.

The platform includes an opening 64 from which the upsetting element protrudes. The timer element drives contact between the block elements and the upsetting element dislodging/transforming the block elements assembled on the platform simulating a demolition of the tower at the expiration of the set period of play time, as seen in FIG. 1B. In various modes of play, the timer element can be paused between each players turn by toggling the on/off switch 60 back and forth to intermittently pause the set period of play time, or alternatively, the timer may continue to run from start to finish without stopping. Additionally, the game can also end before the timer runs out if a player collapses or transforms the tower of layered blocks assembled on the platform while in the process of removing a lower layer block to build up a successive upper layer of blocks during game play.

A method for playing a timer controlled building/demolition game includes the steps of providing a plurality of rectangular block elements layered to form a tower, the tower including one or more upper and lower layers with each adjacent layer stacked in an alternating direction to create frictional coupling between the layers, removing blocks from one or more lower layers to build up successive upper layers to increase the tower height during game play, providing an assembly platform supporting the layered tower of blocks and providing a base resting on a surface supporting the assembly platform. Further steps include providing an upsetting element at the base for dislodging the block elements with respect to the assembly platform, providing a timer element at the base in communication with the assembly platform establishing a predetermined time period in which to play, and driving contact between the assembly platform and the upsetting element dislodging the block elements assembled on the platform at an expiration of the set period of play time.

The method further includes the steps traversing the assembly platform between a first position and a second position at the base, and providing a shifting mechanism in mechanical communication with the assembly platform for traversing the platform between first and second positions. The method further includes the step of providing a detonation lever at the timer element for triggering the shifting mechanism to drop the assembly platform from the first position to the second position, and the step of protruding the upsetting element through the assembly platform when the platform is dropped from the first position to the second position at the base.

From the foregoing, it can be seen that there has been provided a timer controlled building/demolition game which employs block elements assembled on a simply yet uniquely platform which is in communication with a timer element for establishing a time period for play and an upsetting element which dislodges the block elements at the expiration of game play. While a particular embodiment of the present invention has been shown and described, it will be obvious to those skilled in the art that changes and modifications may be made without departing from the invention in its broader aspects.

Therefore, the aim in the appended claims is to cover all such changes and modifications as fall within the true spirit and scope of the invention The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A toy apparatus, comprising:

a plurality of rectangular block elements layered to form a tower, the tower including one or more upper and lower layers with each adjacent layer stacked in an alternating direction to create frictional coupling between the layers, the tower height increasing during game play by removing blocks from one or more lower layers to build up successive upper layers;

an assembly platform supporting the layered tower of blocks;

a base resting on a surface supporting the assembly platform;

an upsetting element at the base for dislodging the block elements with respect to the assembly platform; and a timer element at the base in communication with the assembly platform establishing a predetermined time period in which to play and driving contact between the assembly platform and the upsetting element dislodging the block elements assembled on the platform at an expiration of the set period of play time.

2. The apparatus according to claim 1, wherein the assembly platform is affixed to traverse between a first position and a second position at the base.

3. The apparatus according to claim 2, further comprising a shifting mechanism in mechanical communication with the assembly platform for traversing the platform between first and second positions.

4. The apparatus according to claim 3, wherein the shifting mechanism further comprises a lifting assembly for elevating the assembly platform from the base in the first position and a releasing assembly for dropping the platform toward the base in the second position.

5. The apparatus according to claim 4, wherein the lifting assembly is pivotably coupled to the base and includes a handle and one or more contacting surfaces for manually elevating the assembly platform from the base to the first position.

6. The apparatus according to claim 5, wherein the releasing assembly further comprises a release lever in mechanical communication with the timer element and one or more arm members for supporting the lifting assembly when elevating the platform in the first position, and releasing the lifting assembly to drop the assembly platform to the second position.

7. The apparatus according to claim 6, wherein the upsetting element is affixed to protrude through the assembly platform at the base when the platform is dropped from the first position to the second position.

8. The apparatus according to claim 7, wherein the timer element further comprises a detonation lever for triggering the shifting mechanism to drop the assembly platform from the first position to the second position.

9. The apparatus according to claim 8, wherein the timer element further comprises a gear assembly coupled to the detonation lever and a pull string for winding up the gear assembly.

10. The apparatus according to claim 9, wherein the timer element further comprises an on/off lever in mechanical communication with the gear assembly for manually stopping the timer element to intermittently pause the set period of play time.

11. A method for playing a timer controlled building/demolition game, comprising the steps of:

layering a plurality of rectangular block elements layered to form a tower, the tower including one or more upper and lower layers with each adjacent layer stacked in an alternating direction to create frictional coupling between the layers;

removing blocks from one or more lower layers to build up successive upper layers to increase the tower height during game play;

supporting the layered tower of blocks on an assembly platform;

resting a base on a surface supporting the assembly platform with an upsetting element at the base for dislodging the block elements with respect to the assembly platform;

establishing a predetermined time period, using a timer element at the base in communication with the assembly platform; and driving contact between the assembly platform, using the timer element with the upsetting element to transform the block elements assembled on the platform at an expiration of the predetermined time period using the timer element.

12. The method according to claim 11, further comprising the step of traversing the assembly platform between a first position and a second position at the base.

13. The method according to claim 12, further comprising the step of traversing the platform between first and second positions using a shifting mechanism in mechanical communication with the assembly platform for traversing the platform between first and second positions.

14. The method according to claim 13, further comprising the step of dropping the assembly platform from the first position to the second position using a detonation lever at the timer element for triggering the shifting mechanism.

15. The method according to claim 14, further comprising the step of protruding the upsetting element through the assembly platform when the platform is dropped from the first position to the second position at the base.

16. A toy apparatus, comprising:

a base resting on a surface;

an assembly platform affixed to traverse between a first position and a second position at the base;

a plurality of rectangular block elements layered to form a tower at the assembly platform, the tower including one or more upper and lower layers with each adjacent layer stacked in an alternating direction to create frictional coupling between the layers, the tower height increasing during game play by removing blocks from one or more lower layers to build up successive upper layers;

an upsetting element at the base for dislodging the block elements with respect to the assembly platform; and a timer element at the base in communication with the assembly platform establishing a predetermined time period in which to play, and at the expiration of play time, shifting the assembly platform from a first position to a second position driving contact with the upsetting element dislodging the block elements from the platform.

17. The apparatus according to claim 16, further comprising a shifting mechanism in mechanical communication with the assembly platform for traversing the platform between first and second positions.

18. The apparatus according to claim 17, wherein the upsetting element is affixed to protrude through the assembly platform at the base when the platform is dropped from the first position to the second position.

19. The apparatus according to claim 18, wherein the timer element further comprises a detonation lever for triggering the shifting mechanism to drop the assembly platform from the first position to the second position.

20. The apparatus according to claim 19, wherein the timer element further comprises a gear assembly coupled to the detonation lever and a pull string for winding up the gear assembly.

* * * * *